United States Patent [19]

Lonardo

[11] Patent Number: 4,912,788

[45] Date of Patent: Apr. 3, 1990

[54] SEAT PAD FOR INVALID PATIENTS

[75] Inventor: Robert Lonardo, 680 Capri Blvd., Treasure Island, Fla. 33706

[73] Assignee: Robert Lonardo, Treasure Island, Fla. ; Trustee for Robert Lonardo Living Trust Agreement

[21] Appl. No.: 194,869

[22] Filed: May 17, 1988

[51] Int. Cl.[4] ..... A47C 20/02; A47C 27/12

[52] U.S. Cl. ..... 5/432; 5/464; 5/472; 5/436; 297/459

[58] Field of Search ..... 297/DIG. 4, 458, 459, 297/460; 5/431, 432, 434, 436, 442, 464, 481, 450, 472, 448

[56] References Cited

U.S. PATENT DOCUMENTS

| | | | |
|---|---|---|---|
| 2,077,233 | 4/1937 | Greenhill | 5/450 X |
| 2,412,112 | 12/1946 | Wood et al. | 297/459 |
| 2,819,712 | 1/1958 | Morrison | 5/450 |
| 3,000,020 | 9/1961 | Lombard et al. | 297/458 |
| 3,093,407 | 6/1963 | Wilson | 5/481 |
| 3,148,389 | 9/1964 | Lustig | 5/434 |
| 3,158,878 | 12/1964 | Pernell | 5/431 |
| 3,376,070 | 4/1968 | Johnson | 297/459 |
| 3,459,179 | 8/1969 | Olesen | 5/481 |
| 3,503,649 | 3/1970 | Johnson | 297/459 |
| 3,707,008 | 12/1972 | Fellin et al. | 5/481 X |
| 3,890,004 | 6/1975 | Rail | 5/481 |
| 3,987,507 | 10/1976 | Hall | 5/436 |
| 4,563,785 | 1/1986 | Samelson | 5/472 |
| 4,588,229 | 5/1986 | Jay | 297/459 |
| 4,630,863 | 12/1986 | Roberts | 297/459 |
| 4,718,727 | 1/1988 | Sheppard | 5/481 X |
| 4,748,768 | 6/1988 | Jacobsen | 5/481 X |
| 4,753,480 | 6/1988 | Morell | 297/459 |
| 4,766,627 | 8/1988 | Landry | 5/448 |
| 4,773,702 | 9/1988 | Takahashi et al. | 297/DIG. 4 X |

FOREIGN PATENT DOCUMENTS

| | | | |
|---|---|---|---|
| 967293 | 5/1975 | Canada | 297/459 |
| 441479 | 7/1925 | Fed. Rep. of Germany | 297/459 |
| 352384 | 8/1922 | France | 5/481 |
| 173548 | 12/1960 | Sweden | 5/481 |
| 342428 | 2/1931 | United Kingdom | 297/459 |
| 2016918 | 9/1979 | United Kingdom | 5/481 |
| 2052965 | 2/1981 | United Kingdom | 297/459 |

OTHER PUBLICATIONS

"Comfortex", Comfortex, Inc., 1986 (Advertisement).
"Roho Heel Pad", Roho, Inc. , (Advertisement).
"PCS Pads", Preventive Care Systems (PCS), E. R. Carpenter Co., 1981.
"HMT TenderFLO II" & TenderGEL II, Health & Medical Techniques, Inc., 1987 (Advertisement).
Advertisement, Better Sleep, Inc., Rx Home Care, Sep. 1984.
"Vasio-Para", Therapeutic Equipment Corp., Rx Home Care, Sep. 1984.
"Roho Low Profile Cushions", Roho, Inc., Rx Home Care, Sep. 1984 (Advertisement).
"Natural Pin Core Latex Foam Wheelchair Cushion", Commander Omni Company, Inc., Rx Home Care, Sep. 1984 (Advertisement).
"Decub-A-Guard", Penox Technologies, Inc., (Advertisement).
"The Vascular Boot", Bio-Sonics, Lunax Corp., (Advertisement).
"Mediscus Air-Support Therapy", The Mediscus Group, (Advertisement).
"Soft-Care Bed Cushion", Gaymar Industries, Inc., (Advertisement).
"Decubitus Pads", Solpar, Rx Home Care, Dec. 1985.
"Dreamshape", ProTech, E. R. Carpenter Co., (Advertisement)

*Primary Examiner*—Gary L. Smith
*Assistant Examiner*—Eric K. Nicholson
*Attorney, Agent, or Firm*—Zarley, McKee, Thomte, Veorhees & Sease

[57] ABSTRACT

The present invention is directed towards a seat cushion for use by a person sitting in a chair or a bed. The seat cushion includes a base layer of padded material with raised cushion areas and depressed recessed areas. The cushion areas correspond to and receive the large muscle masses of the person's buttocks and thighs so as to distribute the person's body weight over the large muscle masses. The recessed areas correspond to the varying body prominences of the patient, such as the ischial bone prominences, so as to receive and suspend the prominences and thereby minimize pressure thereon. The cushion areas are created by stuffing compartments formed on the base with a padding material. The compartments are contoured so as to also define the recessed areas.

7 Claims, 2 Drawing Sheets

SEAT PAD FOR INVALID PATIENTS

BACKGROUND OF THE INVENTION

Persons who have a long term immobility which confines them to a wheelchair or bed are highly susceptible to decubitus ulcers. These ulcers generally occur on bony portions of the body wherein the tissue covering is relatively thin. These ulcers result from prolonged pressure on the thin body tissues which causes reduced blood flow to those tissues.

For example, for a patient seated in a wheelchair or bed, the ischial tuberosities, the lessor trochanters, and sacrum are bony prominences of the body which are covered by minimal skin and muscle tissues so as to be susceptible to decubitus ulcers. Prior art seat cushions have been designed in an attempt to minimize the pressure on these body prominences. Such prior art cushions have been formed from convoluted foam or egg carton construction wherein cavities are filled with air or water. While these prior art cushions may be comfortable, they still exert undesired pressures on the body prominences.

Accordingly, a primary objective of the present invention is the provision of an improved seat cushion for preventing and healing decubitus ulcers.

Another objective of the present invention is the provision of a seat cushion which distributes the body weight over the large muscle masses of the patient's buttocks and thighs.

A further objective of the present invention is the provision of a padded seat cushion having raised cushion areas for receiving the large muscle masses of the patient's buttocks and thighs and which are contoured so as to define recessed areas corresponding to the patient's varying body prominences.

Still another objective of the present invention is the provision of a seat cushion having accessible compartments therein so that the padding within the compartments can be selectively adjusted.

Yet another objective of the present invention is the provision of a seat cushion which is economical to manufacture, and durable and effective in use.

SUMMARY OF THE INVENTION

The seat cushion of the present invention is for use on wheelchairs, conventional chairs, and beds. The seat cushion is portable and reversible and is intended for use by any person having long term immobility which confines them to a chair or bed. The seat cushion is designed to receive the varying prominences of the body wherein ulcers tend to form due to excessive prolonged pressure on the thin tissues covering the prominences.

More particularly, the cushion includes a seat section and a lumbar section, both formed from a dual layer of padded material. The dual layers are sewn together in such a manner as to define compartments therebetween. These compartments are contoured and can be stuffed with padding material so as to define raised cushion areas on each side of the seat cushion. These cushion areas correspond to and receive the large muscle masses of the person's buttocks, thighs and lower back so as to distribute the person's body weight over these large muscle masses. The contours of the cushioned areas also define recessed areas therein which correspond to the body prominences, such as the ischial bones, the lessor trochanters, and the sacrum. These recessed areas receive and suspend the corresponding prominences and thereby minimize pressure on the prominences so as to avoid and/or heal decubitus ulcers. Preferably, the seat cushion is made of a soft fleece-like material.

The raised cushion areas support the large muscle masses throughout the buttocks, approximal and medial thigh, and lumbar which are covered with dense tissue and which can accept excess pressure without causing reduction of blood supply, which leads to decubitus ulcers. Thus, the seat cushion of the present invention redistributes the pressure over these broader muscle masses and away from the thinner tissue which covers the body prominences.

DETAILED DESCRIPTION OF THE DRAWINGS

Figure 1:
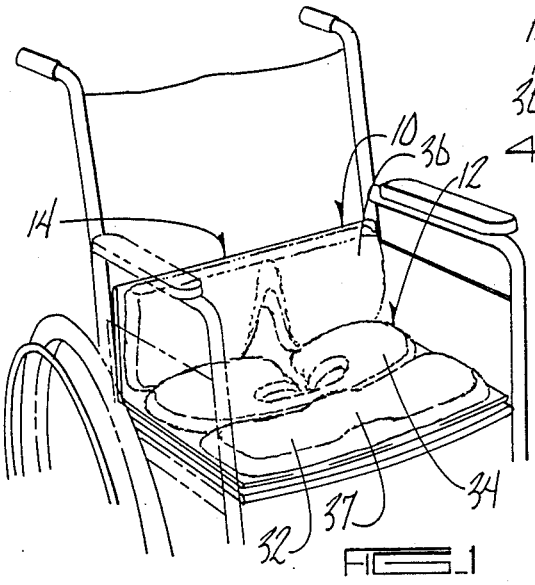
FIG. 1 is a schematic view showing the seat cushion of the present invention in position in a wheelchair.
Figure 2:
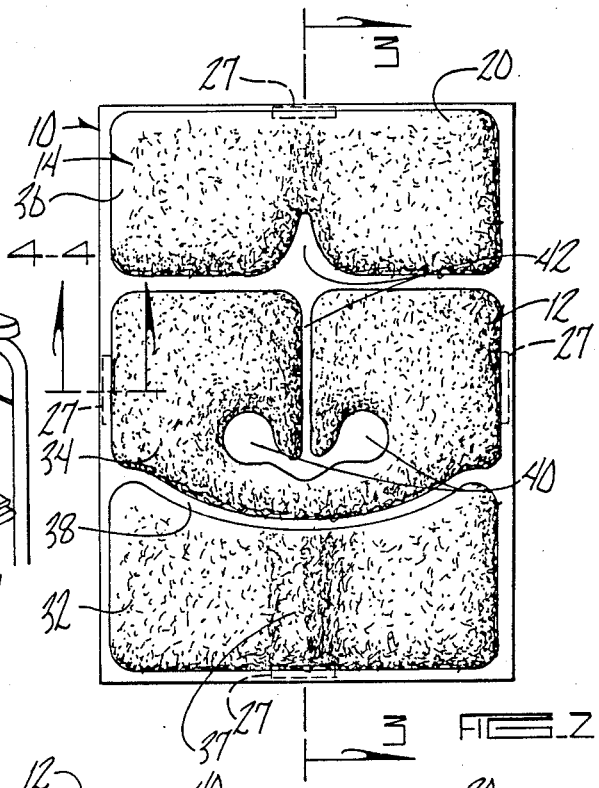
FIG. 2 is a top plane view of the seat cushion laid out flat.

The seat cushion of the present invention is generally designated by the reference numeral 10 in the drawings. Seat cushion 10 can be used in a wheelchair, as depicted in FIG. 1, or any other conventional chair or bed. Preferably, seat cushion 10 includes a seat section 12 and a lumbar section 14. However, the seat cushion can be constructed without the lumbar section, if desired.

Seat cushion 10 includes an upper base layer 16 and a lower base layer 18. In the drawings, base layers 16 and 18 are shown to be a continuous piece of material folded over upon itself, however, two separate layers may be utilized and sewn together at their mating ends. Preferably, base layers 16 and 18 include fleecing or fleece-like material 20 so as to provide padding.

Figure 4:
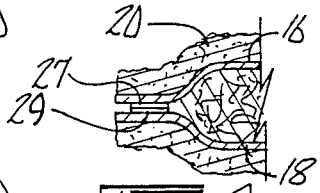
FIG. 4 is a sectional view taken along lines 4—4 of FIG. 2.

An anterior compartment 22, a posterior compartment 24, and a lumbar compartment 26 are formed between the upper and lower base layers 16, 18 by sewing the base layers together along predetermined seams 28. Compartments 22, 24 and 26 are stuffed with padding material 30, such as a fluffy, Kodel polyester fiber. Each compartment has an opening 27 which is closed by Velcro 29 or the like, as seen in FIG. 4, so that the amount of stuffing in each compartment can be varied.

Figure 7:
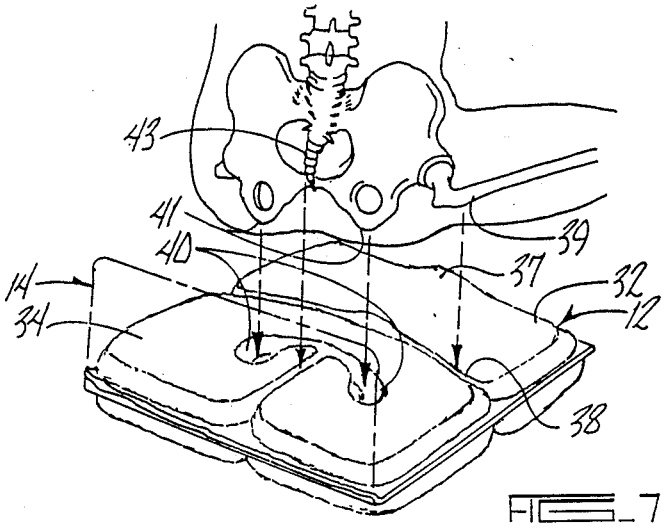
FIG. 7 is an exploded partial perspective view showing corresponding locations of body prominences and seat cushion recesses.

The stuffed compartments 22, 24 and 26 form an anterior cushion 32, a posterior cushion 34 and a lumbar cushion 36, respectively. Anterior compartment 22 can be stuffed with extra padding along the longitudinal center thereof so as to provide an excessively raised portion 37 on anterior cushion 36, as best seen in FIGS. 1 and 7. The raised cushion areas 32, 34 and 36 exist on both sides of seat 10, such that the cushion is reversible.

Figure 5:
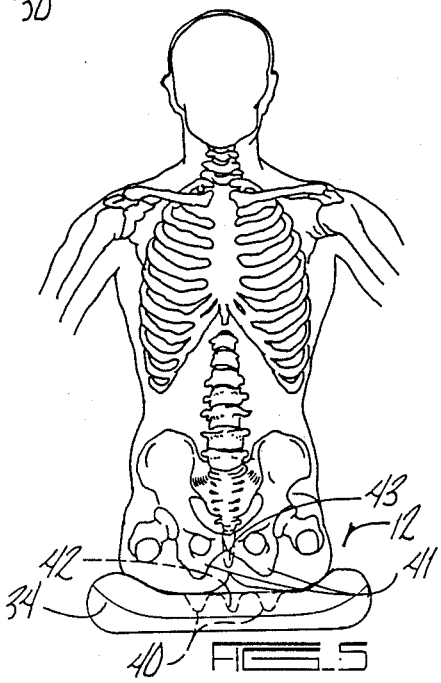
FIG. 5 is a schematic rear view showing a person seated on the seat cushion of the present invention.
Figure 6:
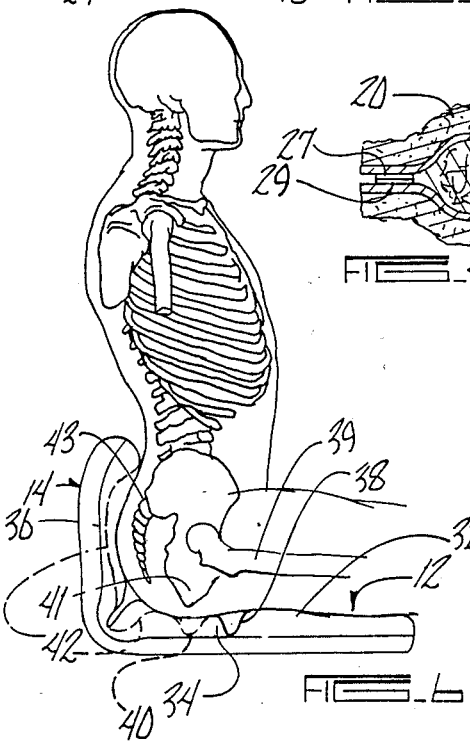
FIG. 6 is a schematic side view showing a person seated on the seat cushion of the present invention.

Anterior cushion 32 corresponds to the large muscle masses in the patient's thighs, as seen in FIG. 6. The posterior cushion 34 corresponds to the large muscle masses of the patient's buttocks, as seen in FIGS. 5 and 6. Similarly, the lumbar cushion 36 corresponds to the large muscle masses in the patient's lower back, as also seen in FIG. 6.

Figure 3:
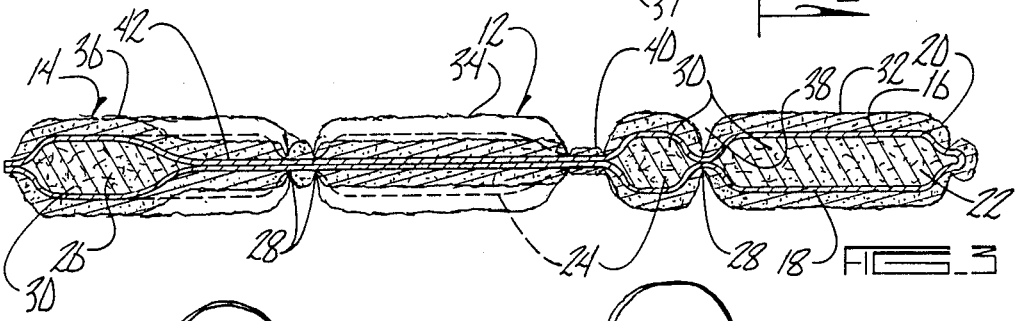
FIG. 3 is a sectional view taken along 3—3 of FIG. 2.

Each cushion 32, 34 and 36 is contoured so as to define recessed areas which correspond to the varying prominences of the patient's body. For example, a recessed area 38 is formed between anterior and posterior cushions 32 and 34 and corresponds to the patient's lessor trochanters 39, as seen in FIGS. 6 and 7. Within the posterior cushion 34 are two depressions 40 which correspond to the ischial bone prominences 41 of the patient, as seen in FIGS. 5–7. A longitudinally elongated depression 42 is formed in posterior cushion 34 and extends into lumbar cushion 36, and corresponds to the patient's sacrum 43. The fleece 20 on base layers 16 and 18 can be thinned or shaved in the recessed areas, such as in recessed area 40 shown in FIG. 3.

Thus, when a patient is seated on seat cushion 10, the elevated cushion areas 32, 34 and 36 provide a large surface area to receive and support the corresponding large muscle masses which include soft, compressible tissue. At the same time, the recessed areas 38, 40 and 42 receive and suspend the various prominences of the patient's body which are covered with a relatively thinner layer of tissue. These recessed areas 38, 40 and 42 substantially eliminate the contact surface with the body tissues covering the bony prominences. This construction of seat cushion 10 distributes the body weight of the patient over the large muscle masses while minimizing the pressure on the body prominences, thereby preventing and/or healing decubitus ulcers which may otherwise form on the body prominences.

Furthermore, anterior cushion area 34 prevents forward and sideways shifting of the body. Also, padding 30 within the compartments 22, 24 and 26 will tend to form to the body's contours to provide a more comfortable seat.

When seat cushion 10 is used in a bed, recessed area 42 minimizes pressure on the sacrum both when the patient is sitting up or when the patient is in a recumbent or semirecumbent position.

While the above description sets forth a preferred embodiment of seat cushion 10, it is understood that other constructions are possible without departing from the scope of the present invention. For example, the seat cushion can be one sided, rather than reversible. Also, the cushion areas can be built up from the base layers 16 and 18, rather than being formed from stuffed compartments.

From the foregoing, it can be seen that the present invention accomplishes at least all of the stated objectives.

What is claimed is:

1. A seat cushion for use by a person sitting in a chair or bed comprising:

two layers of material having a normally closed perimeter edge so as to define opposite sides of a seat section;

at least one contoured compartment formed between the layers of material and being stuffed with padding so as to define contoured cushioned areas corresponding to large muscle masses of the person's buttocks and thighs so as to distribute the person's body weight over the large muscle masses;

the contoured compartment defining recessed areas void of said padding and corresponding at least to the person's ischial bone prominences so as to minimize pressure on the prominences;

the cushioned areas and recessed areas being present on both sides of the seat section; and the material being covered with exterior padding in the cushioned areas to provide further padding to the cushioned areas and the material being substantially void of exterior padding in the recessed areas to provide further recession to the recessed areas.

2. The seat cushion of claim 1 wherein the recessed areas further correspond to the sacrum and lesser trochanters of the person's body.

3. The seat cushion of claim 1 further comprising a closable access opening to the compartment so that the quantity of padding within the compartment can be varied.

4. The seat cushion of claim 1 further comprising posterior and anterior compartments formed in the seat section and containing padding so as to define posterior and anterior cushioned area, respectively, the posterior cushioned areas receiving and supporting the large muscle masses of the person's buttocks and the anterior cushioned areas receiving and supporting the large muscle masses of the person's thighs.

5. The seat cushion of claim 1 wherein the seat section has forward and rearward edges and further comprising a lumbar section extending upwardly from the rearward edge of the seat section so as to provide support and cushioning for the person's lower back.

6. The seat cushion of claim 1 wherein the two layers of material are sewn together along predetermined lines so as to define the cushioned areas and recessed areas.

7. The seat cushion of claim 5 wherein the lumbar section includes two layers of material defining opposite sides of the lumbar section, a contoured compartment formed between the two layers, the compartment defining cushioned areas and a recessed area on each of the opposite sides of the lumbar section, the recessed area corresponding to the person's sacrum so as to minimize pressure on the sacrum.

* * * * *